US006341209B1

(12) United States Patent
Kim et al.

(10) Patent No.: US 6,341,209 B1
(45) Date of Patent: Jan. 22, 2002

(54) METHOD OF CONTROLLING AN INK AGITATOR OF A WET-TYPE ELECTROPHOTOGRAPHY PRINTER

(75) Inventors: Jong-woo Kim, Suwon; Hyong-gu Lee, Kunpo, both of (KR)

(73) Assignee: Sasung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/714,969

(22) Filed: Nov. 20, 2000

(30) Foreign Application Priority Data

Nov. 20, 1999 (KR) ..... 99-51746

(51) Int. Cl.[7] ..... G03G 15/10

(52) U.S. Cl. ..... 399/237; 399/57; 399/58

(58) Field of Search ..... 399/43, 57, 58, 399/61, 62, 119, 127, 120, 233, 237, 238, 239; 430/117, 118, 119; 222/DIG. 1; 347/85, 86, 214; 366/136, 137

(56) References Cited

U.S. PATENT DOCUMENTS 5,652,282 A 7/1997 Baker et al. ..... 523/201

*Primary Examiner*—Arthur T. Grimley
*Assistant Examiner*—Hoan Tran
(74) *Attorney, Agent, or Firm*—Robert E. Bushnell, Esq.

(57) ABSTRACT

A method of controlling an ink agitator of a wet-type electrophotography printer. The method includes the steps of checking and determining the extent of the printer non-usage time during the printer initialization operation, selecting the driving time of the ink agitator according to the extent of the non-usage time from the first step, and driving the ink agitator according to the ink agitator driving time selected at the second step. Here, the printer non-usage time determining step determines whether the non-usage time is a first selection time, a second selection time, or a third selection time and sets a first, second and third ink agitator driving time according to the length of the non-usage time. Accordingly, because the ink agitator is driven according to the non-usage time of the printer, it is able to completely dissolve deposition and lumps of ink even when the non-usage time is substantially long. Also, in cases where the ink agitator driving time is longer than the time taken to completely disperse the developer within the circulation tanks, when dispersion of the developer within the circulation tanks is completed, the printer is able to perform printing operations and the ink agitator is continually driven throughout the set time. Therefore, uniform initialization operation time can be maintained regardless of the non-usage time of the printer.

20 Claims, 5 Drawing Sheets

METHOD OF CONTROLLING AN INK AGITATOR OF A WET-TYPE ELECTROPHOTOGRAPHY PRINTER

CLAIM OF PRIORITY

This application makes reference to, incorporates the same herein, and claims all benefits accruing under 35 U.S.C. §119 from an application for METHOD FOR CONTROLLING INK AGITATING DEVICE OF A LIQUID ELECTROPHOTOGRAPHIC COLOR PRINTER earlier filed in the Korean Industrial Property Office on Nov. 20, 1999 and there duly assigned Serial No. 51746/1999.

BACKGROUND OF THE INVENTION

1. Field of the Invention

This invention relates to a control method of an ink agitator of a wet-type electrophotography printer, and more particularly to a control method of an ink agitator of a wet-type electrophotography printer.

2. Description of the Prior Art

Generally, a wet-type electrophotography printer forms an electrostatic latent image by shooting a laser beam onto a photosensitive medium such as a photosensitive belt, and prints the desired image by developing the electrostatic latent image with a developer liquid that is mixed from a liquid carrier having a solid toner and a solvent and having a predetermined coloring, and then copying the same image on to printing paper.

In one wet-type electrophotography printer, a belt shape photosensitive medium is wound on rollers which are installed within the printer main body, and the medium is installed such that it rotates in a fixed orbit. Around this photosensitive medium, units including an electrification unit, exposure unit, developing unit, drying unit, and copy/fixing unit are installed. In addition, near the developing unit, there is installed a developer supply device which continuously supplies developers of certain concentration to the developing unit. Here, the developer is a mixture of concentrated ink containing a powdered toner and a liquid carrier, in which the toner is at approximately 24 wt %. The toner includes pigments that represent yellow, magenta, cyan, or black colors.

The developer supply device includes numerous circulation tanks which store developers that are to be supplied to the developing unit, numerous injection nozzles which spray the developer within each circulation tank on to the development gap of the developing unit, numerous ink storage tanks which store concentrated ink that correspond to respective colors that are to be supplied to the circulation tanks, a carrier storage tank which stores the carrier that is to be supplied to the circulation tanks, a waste tank for collecting used developers that come from the circulation tanks, and a developer filling and used-developer collecting unit for recovering used-developers collected in the waste tank with a refill cartridge that is empty inside, along with refilling the concentrated ink or carrier of a refill cartridge to the ink storage tank or carrier storage tank. In addition, the developer supply device is provided with concentration measuring sensors for measuring the concentration of the developer stored in the circulation tank, and an ink agitation device for agitating the concentrated ink stored in the ink storage tank.

The ink used in the wet-type electrophotography printers is composed of a hydrocarbon solution which is an insulating dispersion media, organosol which is an organic substance serving as a binder, pigments which are dyes, and charge directors which are salts yielding positively and negatively charged ions, such that the ink may possess electrical characteristics. An example of this type of ink is disclosed in U.S. Pat. No. 5,652,282, to Baker et al., entitled LIQUID INKS USING A GEL ORGANOSOL.

A wet-type electrophotography printer which uses this type of ink to form images must regularly agitate the ink, which is the developing substance, during operation. One characteristic of this ink is that, when left alone for a substantial amount of time, a phenomenon occurs in which the organosol constituent, which is distributed throughout the developer liquid, deposits and turns into lumps, and therefore the deposited ink must be dispersed again.

The concentrated ink within the ink storage tank of the developer supply device has approximately a 17% % Solid concentration, and the developer in the circulation tanks has approximately 2.3 to 3.5% % Solid concentrations. The actual requisite concentration is around 3%, but concentrated ink is used so that a larger amount of ink may be supplied using the same capacity ink storage tank. If, however, a more highly concentrated ink than that currently used is stored, the viscosity of the ink becomes too high and operations of appropriately dispersing and supplying the developer become difficult. Given the same amount of time since the ink was last agitated, an ink storage tank that contains highly concentrated developer requires more time to disperse the developer than that of the circulation tanks containing a developer of lower concentration.

Because of the above reasons, the ink agitator which is provided in the developer supply device of a printer includes agitation wings which are rotatably installed in each ink storage tank, a motor which is the driving power source for the agitation wings, and force transmission unit which conveys the driving force of the motor to the agitation wings. The force transmission unit includes follower pulleys which are mounted on the upper end of the rotation shaft of the agitation wings, a driver pulley which is mounted on the shaft of the motor, and a belt which is installed such that it winds and goes around the follower pulleys and the driver pulley.

The control method of an ink agitator composed as above will now be described. When power is turned on and the printer performs initializing operations, the ink agitator is driven and starts to agitate the ink stored in the ink storage tanks. The driving of the ink agitator stops at the completion time of initialization and the agitation operation is completed.

Then, the printer displays an indication that the printer is in the 'READY' state, and when there is data to be printed the printer performs printing. Here, the initialization operation period of the printer is approximately 1.5 minutes to 2 minutes. That is, the agitator is driven for 1.5 to 2 minutes and dissolves deposits and lumps of ink by agitating the ink in the ink storage tanks.

However, because the conventional ink agitator control method described above controls the agitator such that the agitator is driven only during the initialization time, for example, 1.5 to 2 minutes, for all situations including cases where the printer has not been turned on for a substantial amount of time (for example, more than seven days), there is a difficulty in maintaining an adequate concentration of the developer because ink deposits and lumps of ink have not been completely dissolved.

Furthermore, if the concentrated ink that has not been completely dispersed is supplied to the circulation tanks from the ink storage tanks, concentration in the circulation tank is detected inaccurately. Additionally, the undispersed particles accumulates in the tubular developer supply paths and eventually the paths get clogged, leading to and faulty development and preventing high quality image printing.

On the other hand, to resolve the above problems, the ink may be completely dispersed by prolonging the initialization time. However, this causes other problems related to inconvenience in printer usage due to long waiting and standby times.

SUMMARY OF THE INVENTION

It is therefore an object of the present invention to provide an improved electrophotographic printer and printing method.

A further object of the invention is to provide an electrophotographic printing method which provides uniform dispersion of ink before printing.

A yet further object of the invention is to provide a printing method which shortens the waiting time for printing.

The present invention is disclosed taking into consideration the problems set forth, and provides a control method for an ink agitator of a wet-type electrophotographic printer that allows uniform dispersion of ink within liquid carriers, which is the dispersion media, through complete dissolving of deposition and lumps even for cases where the non-usage time of the printer is substantially long, by checking the non-usage period of the printer and variably controlling the driving time of the ink agitator according to the extent of the checked non-usage period.

The present invention also provides a control method for an ink agitator of a wet-type electro-photography printer that allows uniform dispersion of ink within liquid carriers, which is the dispersion media, through complete dissolving of deposits and lumps by variably controlling the driving time of the ink agitator according to the non-usage time of the printer without prolonging the initialization time of the printer.

The control method for an ink agitator of a wet-type electro-photography printer according to the present invention includes the steps of checking and determining the extent of the printer non-usage time during the printer initialization operation, selecting the driving time of the ink agitator according to the extent of the non-usage time from the first step, and driving the ink agitator according to the ink agitator driving time selected at the second step.

Here, the non-usage time determining step of the printer determines the time by remembering the time of power 'off' and checking the time from then to the time of power 'on', and makes a classification into a first selection time, a second selection time, or a third selection time according to the length of the non-usage time. Preferably, the first selection time is set as two days or shorter, the second selection time is from three days to seven days, and the third selection time is from eight days to forty days or shorter.

The selecting step of the ink agitator driving time sets the driving time such that when the printer non-usage time is the first selection time, it is normal initialization time, that is the first driving time, for the second selection time it is a second driving time, and for the third selection time it is a third driving time.

Preferably, the first driving time is from 1.5 minutes to 2 minutes, the second driving time is 5 minutes, and the third driving time is 15 minutes. Further, the time for agitating the developer within the circulation tanks is equal to or shorter than the selected first driving time.

According to the above, the ink agitator driving time is selected differently according to the extent of deposition and lumping of the concentrated ink, and the agitator is driven throughout this selected time and completely dissolves ink deposition and lumps.

Accordingly, because the ink is supplied to the circulation tank at a state that maintains normal particle rate and density distribution, the concentration of the developer can be uniformly maintained and clear images may be obtained.

Meanwhile, the control method for an ink agitator of a wet-type electro-photography printer for achieving another object of the present invention includes the steps of: checking and determining the extent of the printer non-usage time during the printer initialization operation; variably selecting the driving time of the ink agitator according to the extent of the non-usage time from the first step; driving the ink agitator according to the ink agitator driving time selected at the second step; and during the driving of the ink agitator according to the third step, completing the initialization is operation of the printer when the agitation of the developer within the circulation tanks is completed. Here, the ink agitator is characterized in that it is continually driven throughout the selected time even after the initialization operation of the ink agitator is completed and 'READY' is displayed on the printer.

According to the above, in case the driving time of the ink agitator is selected as a time longer than normal initialization operation time, the initialization operation is completed when the agitation operation of the low concentration developer within the circulation tanks is completed, that is, when the toner particles within in the developer are sufficiently dispersed and development is enabled, and because printing operations are enabled by the normal detection of the concentration value of the developer which is detected with a concentration sensor within the circulation tanks, prolonging of the initialization operation time of the printer may be prevented according to the application of the present invention.

Therefore, the present invention is able to sufficiently agitate the ink within the ink storage tanks into a normal particle rate and concentration (density) distribution without prolonging the initialization operation time of the printer, and accordingly is able to obtain high quality clear images regardless of the non-usage time of the printer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
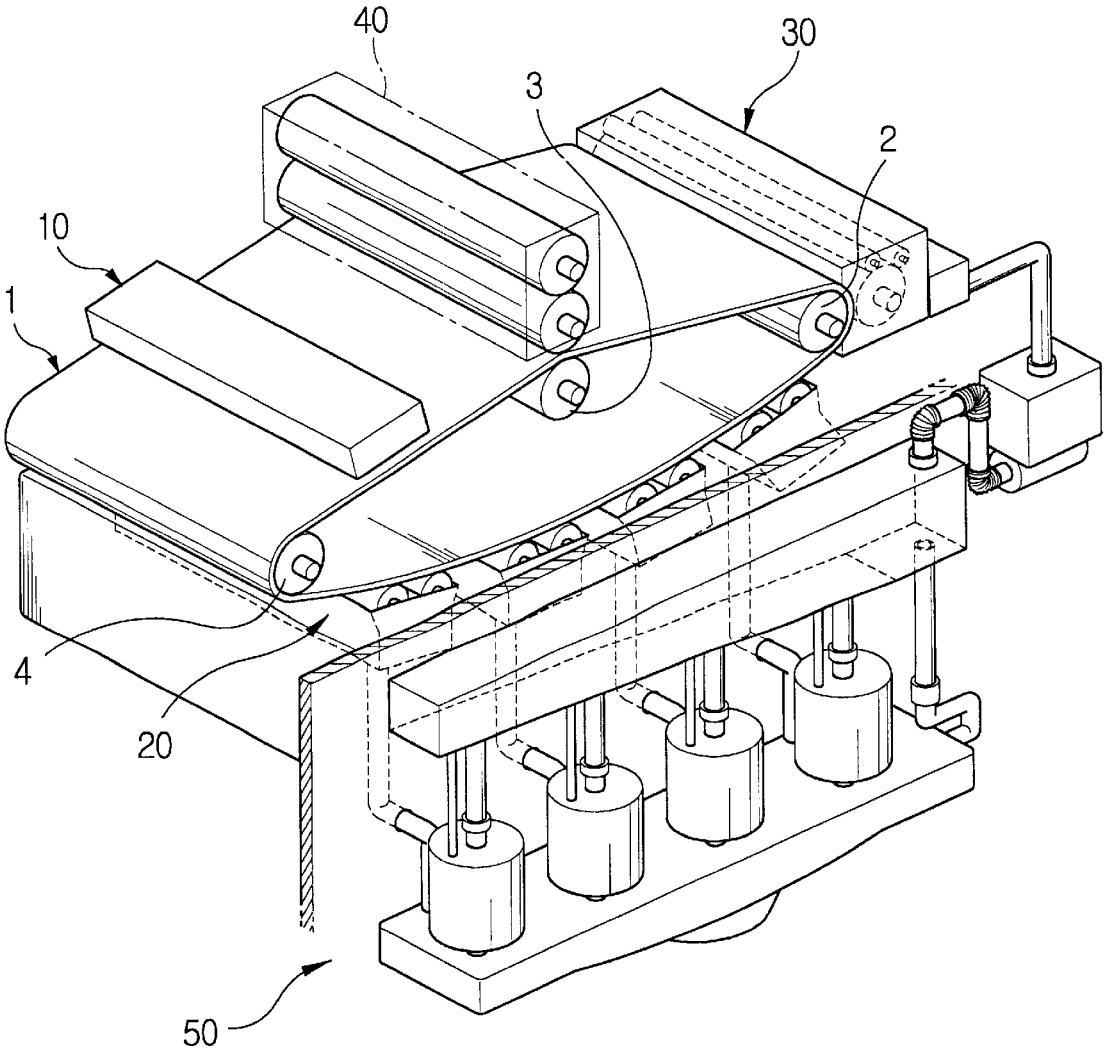
FIG. 1 (PRIOR ART)
FIG. 1 is a schematic view showing the main components of a conventional wet-type electrophotography printer.

Turning now to the drawings, the electrophotographic printer described earlier will now be explained with reference to FIGS. 1 to 4. Main components of the wet-type electrophotography printer are schematically depicted in FIG. 1. As depicted in FIG. 1, a belt shape photosensitive medium 1 is wound on rollers 2, 3, and 4 which are installed within the printer main body (not shown), and the medium is installed such that it rotates in a fixed orbit.

Around said photosensitive medium 1, units including an electrification unit 10, exposure unit (not shown), developing unit 20, drying unit 30, and copy/fixing unit 40 are installed. In addition, near said developing unit 20, there is installed a developer supply device 50 which continuously supplies developers of certain concentration to the developing unit 20. Here, the developer is a mixture of concentrated ink containing a powdered toner and a liquid carrier, in which the toner is at approximately 24 wt %. The toner includes pigments that represent yellow, magenta, cyan, or black colors.

Figure 2:
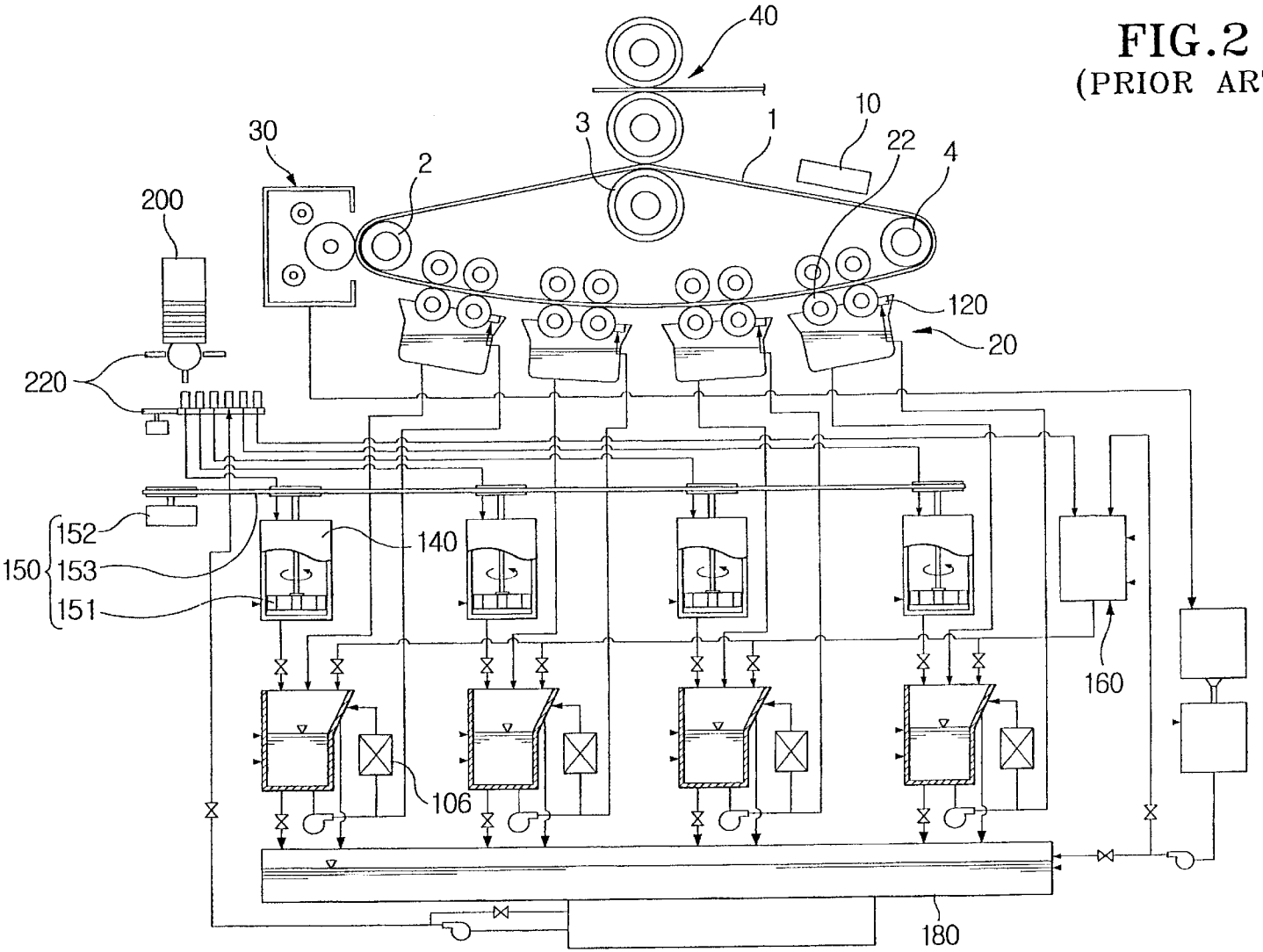
FIG. 2 (PRIOR ART)
FIG. 2 is a systematic diagram showing the composition of a developer supply device of the printer shown in FIG. 1.

As depicted in FIG. 2, the developer supply device 50 includes numerous circulation tanks 100 which store developers that are to be supplied to the developing unit 20, numerous injection nozzles 120 which spray the developer within each circulation tank 100 on to the development gap of the developing unit 20, numerous ink storage tanks 140 which store concentrated ink that correspond to respective colors that are to be supplied to the circulation tanks 100, a carrier storage tank 160 which stores the carrier that is to be supplied to the circulation tanks 100, a waste tank 180 for collecting used developers that come from the circulation tanks 100, and a developer filling and used-developer collecting unit 220 for recovering used-developers collected in the waste tank 180 with a refill cartridge that is empty inside, along with refilling the concentrated ink or carrier of a refill cartridge 200 to the ink storage tank 140 or carrier storage tank 160. In addition, the developer supply device 50 is provided with concentration measuring sensors 106 for measuring the concentration of the developer stored in the circulation tank, and an ink agitation device 150 for agitating the concentrated ink stored in the ink storage tank 140.

The concentrated ink within the ink storage tank 140 of the developer supply device 50 has approximately a 17% % Solid concentration, and the developer in the circulation tanks 100 has approximately 2.3 to 3.5% % Solid concentrations. The actual requisite concentration is around 3%, but concentrated ink is used so that a larger amount of ink may be supplied using the same capacity ink storage tank. If, however, a more highly concentrated ink than that currently used is stored, the viscosity of the ink becomes too high and operations of appropriately dispersing and supplying the developer become difficult. Given the same amount of time since the ink was last agitated, an ink storage tank that contains highly concentrated developer requires more time to disperse the developer than that of the circulation tanks containing a developer of lower concentration.

Figure 3:
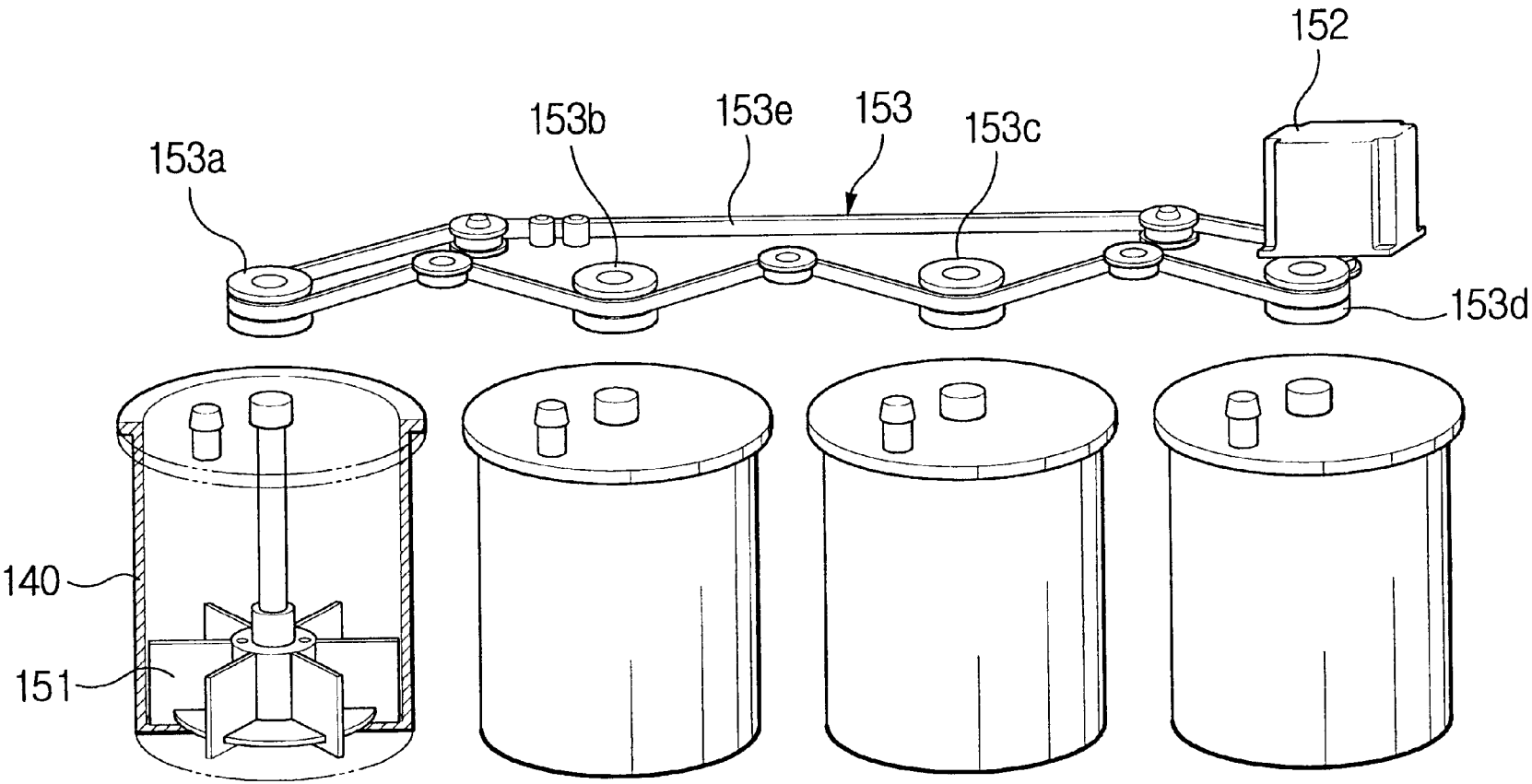
FIG. 3 (PRIOR ART)
FIG. 3 is a sectional perspective view of only the agitator from the developer supply device of FIG. 2.

Because of the above reasons, the ink agitator 150 which is provided in the developer supply device of a printer includes agitation wings 151 which are rotatably installed in each ink storage tank 140, a motor 152 which is the driving power source for the agitation wings 151, and force transmission unit 153 which conveys the driving force of the motor 152 to the agitation wings 151, as depicted in FIG. 3. The force transmission unit 153 includes follower pulleys 153*a*, 153*b*, and 153*c* which are mounted on the upper end of the rotation shaft of the agitation wings 151, a driver pulley 153*d* which is mounted on the shaft of the motor, and a belt 153*e* which is installed such that it winds and goes around the follower pulleys 153*a*, 153*b*, and 153*c* and the driver pulley 153*d*.

Figure 4:
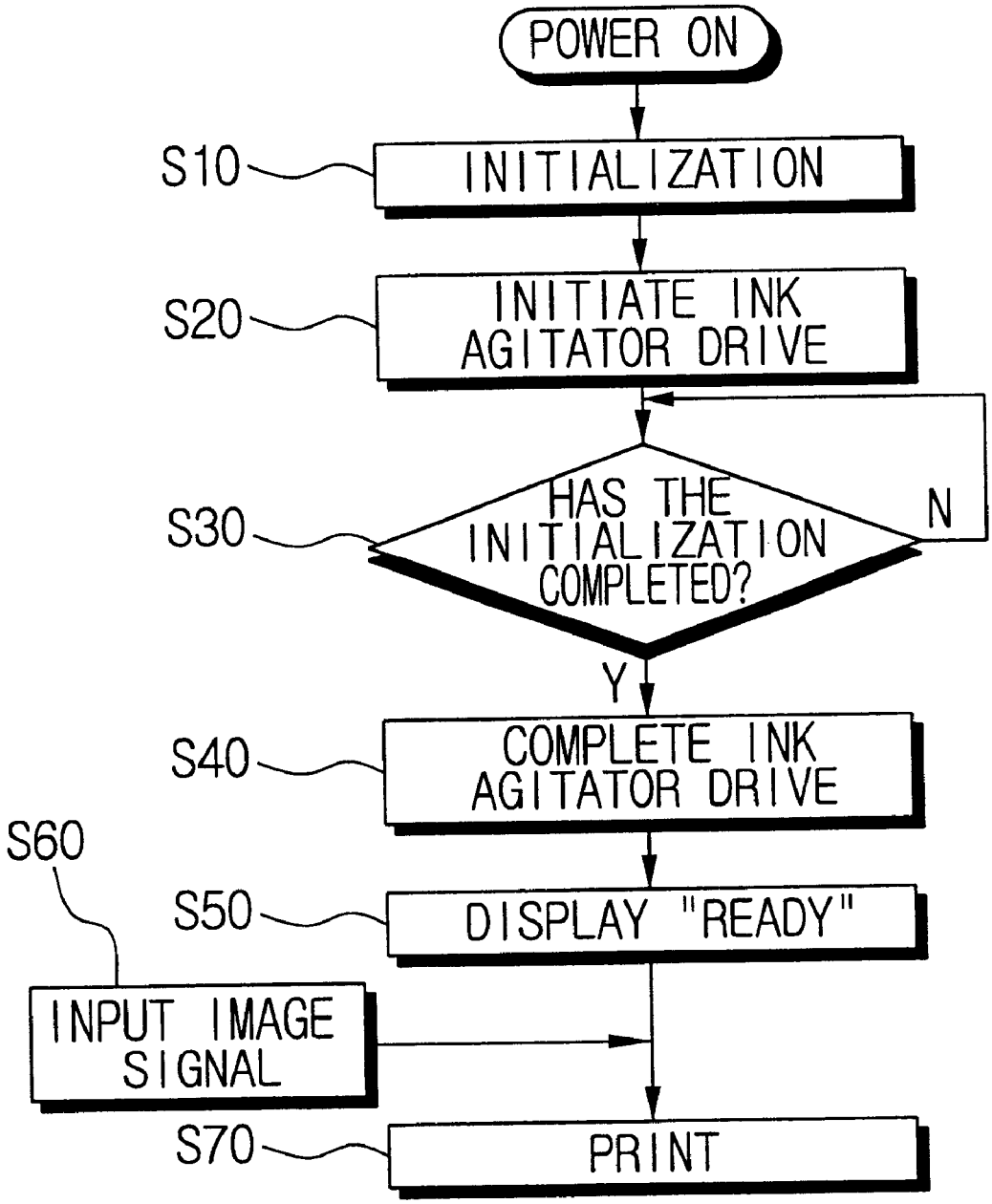
FIG.4 (PRIOR ART)
FIG. 4 is a flow chart of a conventional ink agitator control method.

The control method of an ink agitator composed as the above is described hereinafter with reference to FIG. 4. When power is turned on and the printer performs initializing operations (Step S10), the ink agitator is driven (Step S20) and starts to agitate the ink stored in the ink storage tanks. The driving of the ink agitator stops at the completion time of initialization (Step S30) and the agitation operation is completed (Step S40).

Then, the printer displays an indication that the printer is in the 'READY' state (Step S50), and when there is data to be printed (Step S60) the printer performs printing (Step S70). Here, the initialization operation period of the printer is approximately 1.5 minutes to 2 minutes. That is, the agitator is driven for 1.5 to 2 minutes and dissolves deposits and lumps of ink by agitating the ink in the ink storage tanks 140.

Figure 5:
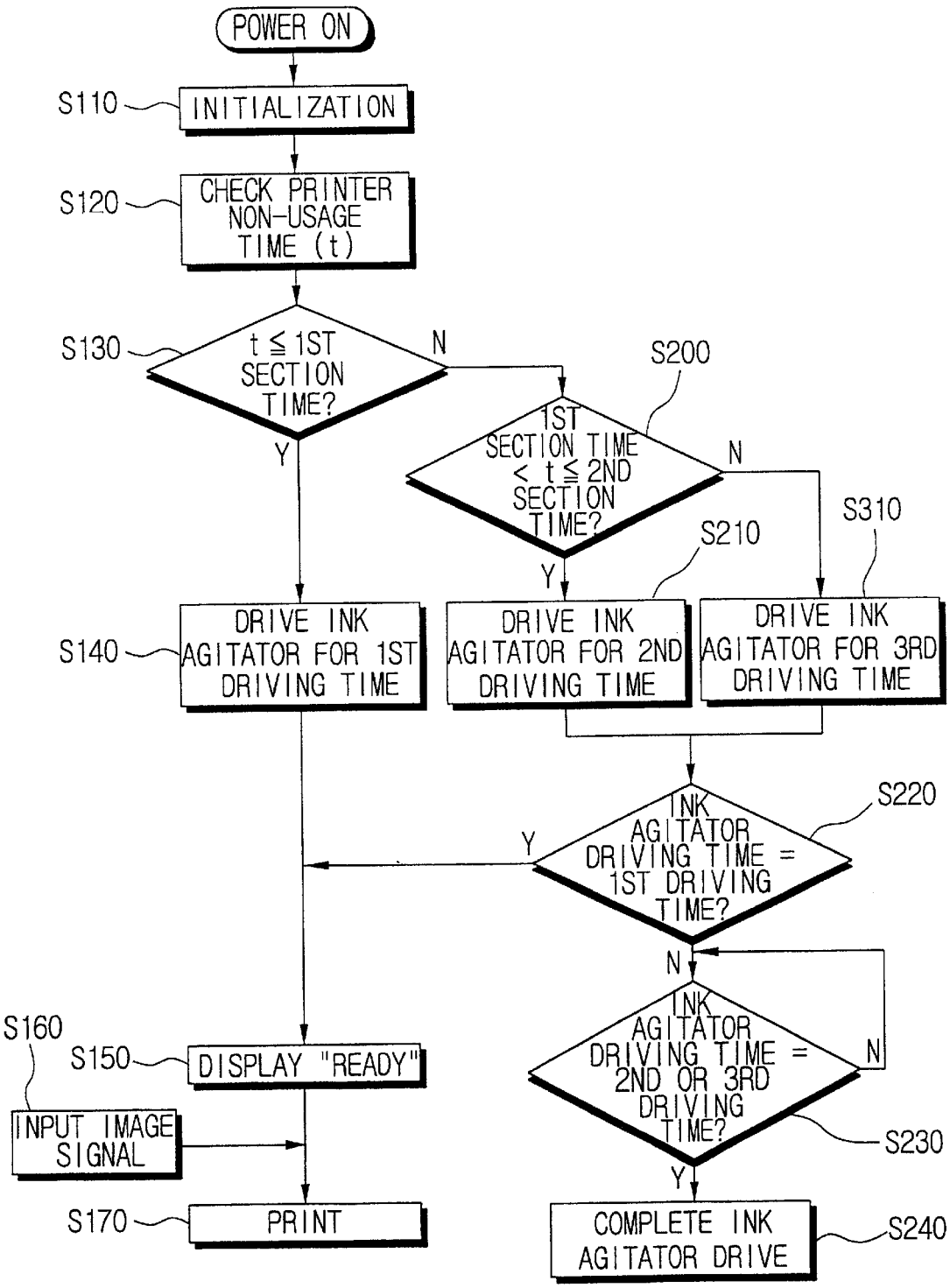
FIG. 5 is a flow chart of the ink agitator control method according to a preferred embodiment of this invention.

FIG. 5 is a flow chair of the ink agitator control method according to one preferred embodiment of this invention. The method of the present invention may be applied to an electrophotographic printer such as the conventional one described heretofore. Therefore, in describing the method, by way of example, reference will be made to elements and reference numbers found in FIGS. 2 and 3. However, the method of the present invention is applicable to other printers having corresponding elements.

As shown in FIG. 5, the ink agitator control method according to this invention involves checking, or determining, a non-usage time of the printer, for example the power 'off' time of the printer, before performing printing. The method then involves setting the driving time of the ink agitator 150 differently according to the determined non-usage time of the printer and then driving the agitator, thereby allowing the concentrated ink stored in the ink storage tanks 140 to be supplied to the circulation tanks 100 in a dispersed (dissolved) state.

More specifically, when the power is turned on, the printer performs an initialization operation (Step S110). At this point, according to the characteristics of this invention, the non-usage time (t) of the printer is determined concurrently with the initialization operation (Step S120), that is, after the power is turned on and before printing is performed. The non-usage time may be the power "off" time, that is, the elapsed time from when the power was last turned off to when it is turned on.

The step S120 includes the operations of recalling the time of the power of the printer being turned 'off' at a control circuit (not shown) and determining the elapsed time from the 'off' time to the time when the printer is turned 'on' again. To be able to recall the time of the power being turned off, the printer will have a clock which continues to function while the printer power is "off" and the control circuit may save the value of the current time in a memory at the time that the power is turned off. Alternatively, a timer which runs while the printer power is "off" may be started when the printer is turned off. Step S120 also includes classifying, by the control circuit, of the determined printer non-usage time value into one of at least three time range groups including a first selection time, a second selection time, and a third selection time, according to the length of the non-usage time and then storing the corresponding selection time value. The printer non-usage time may alternatively be classified using more than three range groups, in a more elaborate classification scheme. According to one embodiment of the present invention, classification is made using three time range groups in which the first selection time is two days or shorter, the second selection time is from three days to seven days, and the third selection time is from eight days to forty days.

Then, the control circuit sets the driving time of the ink agitator according to the classified non-usage time of the printer. Here, the ink agitator driving time is set such that, if the printer non-usage time (t) is determined to be under the first selection time, the driving time is set to a first driving time (normal initialization operation time), if determined to be the second selection time, a second driving time, and if determined to be the third selection time, a third driving time. In one embodiment of the invention, if the non-usage time of the printer exceeds the third selection time and the ink is within its life span, the third driving time is used as the agitation time. This method is used for the typical situation where, after the maximum value of the third selection time, the developer tends not to further deposit or form lumps, and the third driving time is adequate to sufficiently disperse the developer. Note that atypical lifetime of ink is approximately one and a half years.

For instance, an embodiment of the invention has been tested with the agitator drive time set to approximately 2 minutes for under two days of non-usage time, 5 minutes for three to seven days, and 15 minutes for eight to forty days, and it has been experimentally verified that 100% of the concentrated ink is dispersed. In another embodiment, these selection times may be varied depending on the temperature value of the separation transition of ink. However, because the object of this invention does not relate to accurate time but rather to the providing of a control method requisite to the agitation of ink along with the initialization operation time of the printer, the selected selection times or driving, times may fluctuate somewhat.

When the non-usage time (t) is classified to be under the first selection time (Step S130) as a result of the printer non-usage time determining step of S120, the ink agitator driving time is set to the first driving time and the agitator is driven (Step S140), and the printer completes normal initialization operation and may display 'READY' (Step S150). Then, if there is data to be printed (Step S 160), it performs printing (Step S170) and concludes the operation.

On the other hand, if the non-usage time (t) is classified to be of the second selection time (Step S200) as a result of the printer non-usage time determining step of S120, the ink agitator driving time is set to the second driving time and the agitator is driven (Step S210). Here, the ink agitator driving time is set to the second driving time which is longer than that of the normal initialization operation time (for example 1.5 to 2 minutes) and the initialization operation time of the printer is prolonged. Therefore, to make the initialization operation time uniform, this invention controls the printer such that the initialization operation is completed and 'READY' is displayed during the time when the agitation of the developer within the circulation tanks is completed while the ink agitator is being driven for the set time selected as above (Step S220). That is, initialization is completed and printing may begin before agitation is completed. The ink agitator may be continuously driven throughout the set time (Step S230), and when the set time is reached, the driving of the ink agitator stopped (Step S240).

Further, if the printer non-usage time (t) is classified to be a time exceeding the minimum for the third selection time as a result of the determining step of S120, the ink agitator driving time is set to the third driving time and the agitator is driven (Step S310). Likewise in this case, initialization is completed and printing is enabled during the time when the agitation of the developer within the circulation tanks is performed while the ink agitator is being driven for the set time (Step S220). The ink agitator may be continuously driven throughout the set time (Step S230), and when the set time is reached, the driving of the ink agitator is stopped (Step S240).

That is, the ink agitator control method according to this invention determines the printer non-usage time during the initialization operation of the printer, and the ink agitator driving time is selected and the agitator is driven according to the determined non-usage time, and thereby the driving of the ink agitator is controlled such that the agitator may completely dissolve deposits and lumps of ink within the ink storage tanks 140 even when the printer non-usage time has been long.

In addition, when the ink agitator driving time is set to a time longer than the normal initialization operation time due to the non-usage period be extensive, the initialization operation time is kept uniform by completing the printer initialization operation during the time that the ink agitator is being driven to complete the agitation of the developer within the circulation tanks.

According to the present invention described heretofore, the driving time of the ink agitator is variably selected according to the extent of deposition and lumping of concentrated ink, and the ink agitator is driven throughout the selected time and thereby the deposits and lumping of ink are completely dissolved. Therefore, because the ink stored in the ink storage tanks is supplied to the circulation tanks at a state having normal particle rate and concentration (density) distribution, the concentration of the developer may be maintained at a uniform rate and high quality clear images may be obtained.

Also, according to the present invention, in case the ink agitator driving time is set to a time longer than that of the normal initialization operation time of the printer, the initialization operation is not completed when the driving of the agitator is completed, but rather it is completed at the time when the agitation of the developer within the circulation tanks is completed while the ink agitator is being driven for the set time, and 'READY' is displayed and printing operations may be performed from that time on. That is to say, the initialization operation time of the printer may be maintained at a uniform state.

It is to be understood, however, that even though the present invention has been described with reference to the annexed drawings which depict the preferred embodiments thereof, the present invention is not limited to the embodiments, and may apparently be modified in many ways by those ordinarily skilled in the art without departing from the general principle and scope of the invention expressed in the appended claims.

What is claimed is:

1. A method of controlling an ink agitator of a wet-type electrophotographic printer, comprising the steps of:

after turning the printer power on and before printing, determining a value for the non-usage time of the printer;

determining a value of ink agitator driving time which is dependent upon the determined value of the non-usage time; and driving the ink agitator for the determined value of ink agitator driving time.

2. The method of claim 1, further comprising:

said steps of determining the value of the non-usage time and determining the value of the ink agitator driving time, and the beginning of driving the ink agitator, being performed during an initialization process of the printer.

3. The method of claim 2, further comprising:

when there are data to be printed, beginning printing after the initialization process is completed.

4. The method of claim 3, further comprising:

completing the initialization process at a fixed time after the printer power is turned on.

5. The method of claim 3, further comprising:

displaying an indication that the printer is ready after the initialization process is completed.

6. The method of claim 4, further comprising:

completing the initialization process before the driving of the ink agitator is finished.

7. The method of claim 1, said step of determining a value of ink agitator driving time further comprising:

classifying the determined value of non-usage time into one of three groups of time ranges; and determining the value of ink agitator driving time as one of three respective driving time values which are respectively fixed for the time range groups.

8. The method of claim 1, said non-usage time of the printer being the elapsed time from when the printer was last turned off until the printer is turned on.

9. The method of claim 8, said step of determining the value of non-usage time of the printer further comprising:

recalling a value of the time when the printer was last turned off; and determining the value of the non-usage time based on the recalled value and the current time.

10. A method of controlling an ink agitator of a wet-type electrophotographic printer, comprising the steps of:

when the printer is turned on, determining a value for the non-usage time of the printer;

classifying the determined value of non-usage time into one of a first selection time range, a second selection time range whose minimum equals the maximum for the first selection time range, and a third selection time range whose minimum equals the maximum for the second selection time range; and driving the agitator for a value of driving time which is a first, second or third driving time when the non-usage value is classified into the first selection time range, second selection time range or third selection time range, respectively;

said second driving time being greater than said first driving time and said third driving time being greater than said second driving time.

11. The method of claim 10, further comprising:

when there are data to be printed, printing said data after said first driving time has elapsed from the start of driving the agitator.

12. The method of claim 10, further comprising:

after said first driving time has elapsed from the start of driving the agitator, displaying an indication that the printer is ready to print.

13. The method of claim 11, further comprising:

when the printer is turned on, beginning an initialization process of the printer; and completing the initialization process before said first driving time has elapsed from the start of driving the agitator.

14. The method of claim 10, further comprising:

said first selection time range being times up to two days, said second selection time range being from three days through seven days, and said third time range being times greater than eight days.

15. The method of claim 10, further comprising:

said first selection time range being times up to two days, said second selection time range being from three days through seven days, and said third time range being from eight days through forty days.

16. The method of claim 10, further comprising:

the value of driving time corresponding to said first selection time range being approximately 2 minutes;

the value of driving time corresponding to said second selection time range being approximately 5 minutes; and the value of driving time corresponding to said third selection time range being approximately 15 minutes.

17. The method of claim 14, further comprising:

the value of driving time corresponding to said first selection time range being approximately 2 minutes;

the value of driving time corresponding to said second selection time range being approximately 5 minutes; and the value of driving time corresponding to said third selection time range being approximately 15 minutes.

18. The method of claim 10, further comprising:

when power to the printer is turned off, storing the current time value in a memory; and said step of determining the value for the non-usage time of a printer further comprising recalling the time value stored in said memory.

19. The method of claim 10, further comprising:

when power to the printer is turned off, starting a timer in the printer; and said step of determining the value for the non-usage time of a printer further comprising determining the value of said timer.

20. A method of controlling an ink agitator of a wet-type electrophotographic printer, comprising the steps of:

when the printer is turned on, determining a value for the non-usage time of the printer;

classifying the determined value of non-usage time into one of a plurality of time ranges; and driving the ink agitator for a value of driving time which is one of a set of fixed values, one fixed value associated with each of the plurality of time ranges.

* * * * *